US012678652B2

(12) United States Patent
Armour

(10) Patent No.: US 12,678,652 B2
(45) Date of Patent: Jul. 14, 2026

(54) DETACHABLY ATTACHABLE WEIGHT CLIP FOR BARBELLS

(71) Applicant: Michael Armour, Fallon, NV (US)

(72) Inventor: Michael Armour, Fallon, NV (US)

( * ) Notice: Subject to any disclaimer, the term of this patent is extended or adjusted under 35 U.S.C. 154(b) by 0 days.

(21) Appl. No.: 18/639,232

(22) Filed: Apr. 18, 2024

(65) Prior Publication Data

US 2025/0325864 A1 Oct. 23, 2025

(51) Int. Cl.
*A63B 21/072* (2006.01)
*A63B 21/075* (2006.01)
*A63B 21/078* (2006.01)

(52) U.S. Cl.
CPC ..... *A63B 21/0728* (2013.01); *A63B 21/0724* (2013.01); *A63B 21/0726* (2013.01); *A63B 21/075* (2013.01)

(58) Field of Classification Search
CPC ..... A63B 21/0728; A63B 21/0724; A63B 21/0726; A63B 21/075; A63B 21/078
See application file for complete search history.

(56) References Cited

U.S. PATENT DOCUMENTS 4,252,316 A * 2/1981 Price ..... A63B 21/0724 482/106
5,496,243 A * 3/1996 Allen ..... A63B 21/0601 482/106
7,789,814 B1 * 9/2010 Xu ..... A63B 21/0728 482/93
D965,712 S * 10/2022 Myer ..... D21/694
11,911,648 B2 * 2/2024 Dickstein ..... A63B 21/0722
2005/0085352 A1 * 4/2005 Baxter ..... A63B 21/0724 482/100
2011/0173778 A1 * 7/2011 Wales ..... B25G 3/20 16/426
2020/0238126 A1 * 7/2020 Anderson ..... A63B 21/0407
2022/0331643 A1 * 10/2022 Kehlenbach ..... A63B 21/0724
2023/0076538 A1 * 3/2023 Simmons ..... A63B 21/0724
2023/0264064 A1 * 8/2023 Simmons ..... A63B 21/075 482/106
2025/0108248 A1 * 4/2025 Wyncott ..... A63B 21/078

* cited by examiner

*Primary Examiner* — Joshua T Kennedy
(74) *Attorney, Agent, or Firm* — Invention To Patent Services; Alex Hobson

(57) ABSTRACT

A detachably attachable weight clip system includes a weight clip for mounting a free weight to a barbell. A weight clip may be configured on either end of a barbell and weights can be hung from therefrom. A weight clip has a mounting collar that is configured to slide over the end of the barbell and a hook that extends from the mounting collar forming a cradle to receive a weight therein. The hook may be configured to rotate with respect to the mounting collar to position the weight hanging from the hook and a swivel lock may enable a user to lock the hook in a rotational position with respect to the mounting collar. A collar set screw is configured to secure the mounting collar in a fixed position along the barbell and a hook set screw prevents the weight from being dislodged from the hook during exercise.

20 Claims, 8 Drawing Sheets

DETACHABLY ATTACHABLE WEIGHT CLIP FOR BARBELLS

BACKGROUND OF THE INVENTION

Field of the Invention

The present invention discloses a detachably attachable weight clip system including a weight clip for mounting a free weight to a barbell in addition to or in place of general disc-shaped weight plates.

Background

Weightlifting is a fantastic anaerobic exercise. It requires not just muscle, but stamina, concentration, and focus. Second in participation only to walking, exercising with weights is of booming popularity in the United States, with over 43 million active participants. This number has been growing by an average of 750,000 new consumers every year over the last eight years, too. That is bigger and faster growth than any other type of exercise.

Weightlifting can also be a rather aggravating exercise, unfortunately. For instance, adding those disc-shaped weights to the barbell shaft requires both hands to hold and apply. However, the real aggravating inconvenience is there are generally not enough disc weights in the appropriate sizes available at gyms, fitness facilities and/or rehabilitation centers. This means weightlifters spend a lot of time waiting for the disc-shaped weights they need until other weightlifters are done with them.

Gyms and similar facilities need to have many sets of disc weights available to accommodate their clients. Additionally, they must also have many sets of handheld weights like dumbbells and kettlebells. It is rather common for there not to be enough of these weights, though. With so many people seeking the same gear at the same time, not everyone gets the weights they want. This results in gym members spending a lot of time just waiting instead of weightlifting or doing weight exercises.

A primary reason for there not being enough disc-shaped weights is their expense. For instance, a quality pair of tiny two-and-a-half pounders can cost in excess of $20. Two 10-pound discs can easily cost more than $50, and two quality 100-pound weights can cost $475. To operate a gym, fitness center, rehabilitation facility or similar establishment requires many sets of these expensive disc-shaped weights. This expense can be very restrictive to those facilities as well as to individual consumers.

A weightlifter or other fitness lover needs to focus on form and stamina, but they face a lot of inconveniences, costs and delays due to waiting on disc-shaped weights of the right size, and due to the cost of purchasing differently sized weights and types of weights for different exercises.

So, when you add up these factors of inconvenience, the high costs of the weights, and the length of time it can take to access disc weights in gyms, it equals one big aggravation that requires a solution. Further, the weight clip can join a powerful consumer trend. While exercise has always had devoted participants, those numbers have been increasing of late, and especially in the format that is most relevant to the weight clip. There are other attachment devices for weights known in the prior-art.

U.S. patent application Ser. No. 20/110,177922 titled Exercise Barbell discloses an exercise barbell. The exercise barbell includes a first cylindrical bar with an open end slidably engageable with a second cylindrical bar. The invention includes placement of the free weight handle with the shim into the open hinged coupler. Although, the barbell includes a hinged coupler to hold weights it can only carry one weight at each side. This shortcoming significantly limits the user.

U.S. patent application Ser. No. 20/140,024506 titled Dumbell Retention Device discloses a weight lifting apparatus for converting a traditional dumbbell weight into a kettlebell. Although, the weight lifting apparatus includes a handle which can be used to hook it to a barbell, it lacks the feature of rotation and set screws to secure its position.

SUMMARY OF THE INVENTION

The invention is directed to a detachably attachable weight clip system including a weight clip for mounting a free weight to a barbell in addition to or in place of general disc-shaped weight plates. An exemplary weight clip may be configured on either end of a barbell and weights can be hung therefrom. An exemplary weight clip has a mounting collar that is configured to slide over the end of the barbell and a hook that extends from the mounting collar and having a cradle to receive a weight therein. The hook may be configured to rotate with respect to the mounting collar to position the weight hanging from the hook. A swivel lock may be configured between the mounting collar and hook and enable a user to lock the hook in a rotational position with respect to the mounting collar. Also, a collar set screw may be configured to secure the mounting collar in a fixed position along the length of the barbell. A hook set screw may extend through the hook to secure the weight within the cradle of the hook, to prevent the weight from being dislodged from the hook during exercise.

An exemplary mounting collar includes a cylinder having a collar barbell aperture with a diameter for sliding over a barbell. The diameter of the collar barbell aperture may be larger than conventional barbell diameters, such as about 20 mm or more, about 25 mm or 25.4 mm or more, about 30 mm or more or even 40 mm or less, or any range between and including the diameter values provided. Conventional barbells have a diameter of 25.4 mm. Also, the mounting collar may have a length from a first end to a second end of about 25 mm or more, about 30 mm or more, about 40 mm or more, about 50 mm or more, about 75 mm or more and any range between and including the length values provided. A longer mounting collar may be better suited for retaining heavier weights but may take up more length along the barbell.

A mounting collar may be configured with an interior liner along a portion of the interior surface of the mounting collar, or along the collar-barbell aperture. This liner may be a layer or coating of a material that is resilient, such as an elastomeric material. This elastomeric material may dampen any vibrations during exercising to prevent a weight attached to the weight clip from jostling and being dislodged. An interior liner may be silicone, styrene butadiene rubber (SBR), or urethane for example and may have a thickness of about 2 mm or more, about 4 mm or more, about 6 mm or more, and any range between and including the thickness values provided.

A mounting collar may be slid over a barbell and then retained in position by a collar set screw that extends through a collar-threaded aperture of the cylindrical mounting collar. A collar set screw may have threads that engage with threads in the wall of the mounting collar to enable the set screw to be advanced and retracted from the aperture of the mounting collar. Thumb flanges may extend from the exposed end of the collar set screw to facilitate hand tightening of the set screw against a barbell.

An exemplary hook of the weight clip extends from the mounting collar and has a cradle portion for receiving a weight therein. A hook may be a J-hook having a J-shape with a linear extension portion or hook extension and a cradle that is a curved portion of the hook extending from the hook extension to an extended end of the hook. The curved cradle portion of the hook may extend a hook angle of about 140 degrees or more, about 150 degrees or more, about 160 degrees or more to about 180 degrees or any range between and including the values provided. A hook angle of about 160 degrees or more may be preferred to prevent the weight from becoming dislodged from the cradle. The extended end portion of the hook may extend up from the cradle portion to an extended end that is configured up from the bottom of the cradle a portion of the length of the hook extension, thereby forming a J-shaped J-hook. The extended end portion may extend up from the bottom of the cradle a distance of about 50 mm or more, about 75 mm or more, about 100 mm or more, and any range between and including the values provided. The cradle gap distance between the hook extension and the extended end portion, which may be a diameter of the curved cradle portion, may be about 50 mm or more, about 75 mm or more, about 100 mm or more. The handle portion of free-weights maybe larger than the diameter of a barbell and a larger gap distance may provide easy insertion of the free-weight into the cradle.

A weight may be placed in the cradle of the hook and then retained in position by a hook set screw that extends through a hook-threaded aperture of the hook, such as along the hook extension. The hook-threaded aperture may extend through the hook extension proximal to the cradle such that a hook set screw extends toward the extended end portion of the hook. A collar set screw may have threads that engage with threads in the hook-threaded aperture of the hook to enable the set screw to be advanced and retracted. Thumb flanges may extend from the exposed end of the hook set screw to facilitate hand tightening of the set screw against or over a weight configured in the cradle. The hook set screw may extend onto a weight, such as a handle of a kettle bell for example or may extend over the weight, wherein the weight is configured in the cradle and below the hook set screw. In this later configuration, the hook set screw may form a barrier in the hook to prevent the weight from being removed from the cradle.

A hook may be configured with an interior liner along a portion of the interior surface of the cradle of the hook. This liner may be a layer or coating of a material that is resilient, such as an elastomeric material. This elastomeric material may dampen any vibrations during exercising to prevent a weight attached to the weight clip from jostling and being dislodged. An interior liner may be silicone, styrene butadiene rubber (SBR), or urethane for example and may have a thickness of about 2 mm or more, about 4 mm or more, about 6 mm or more, about 10 mm or more and any range between and including the thickness values provided.

The hook may be rotatably coupled to the mounting collar, wherein the hook can be rotated with respect to the mounting collar for preferred positioning of a weight retained by the hook on a barbell. A shaft may extend from the mounting collar and this shaft may be cylindrical in shape having a circular cross-sectional outer surface. A hook-shaft coupling of the hook may extend over this shaft and a swivel lock may be configured to engage with swivel lock threads configured on the shaft to tighten the swivel lock to the hook-shaft coupling to prevent the hook from rotating.

The weight clip may be configured to retain a free weight, or a weight that is not configured as part of a machine that is not easily removed. A free-weight may be a dumbbell, kettlebell or other type of weight with a handle or strap that can be retained in the cradle of the hook. A free-weight maybe a weight that is portable and can be picked up by hand and may have a handle or strap for this purpose.

A weight clip system may enable a weight lifter to detachably attach a desired amount of weight to a barbell for an exercise and then quickly change the weight by detaching the first weight and adding a different second weight or weights. A plurality of weight clips may be added to a barbell with one or more weight clips on a first end of the barbell and one or more weight clips on a second, opposing end of the barbell.

The total length of the weight clip may be about 150 mm or more, about 175 mm or more, about 200 mm or more and any range between and including the lengths provided. The weight clip should be long enough, wherein the cradle is positioned away from the barbell for easy attachment or placement of a free-weight in the cradle.

The primary objective of the weight clip system is to provide a new weight clip that can allow dumbbells and kettlebells to be applied on barbell shafts. The weight clip may be a J-hook design, with a hook on one length-end and a mounting collar on the opposite. The mounting collar is configured with a collar-barbell aperture that has a diameter that accommodates the diameter of barbell shafts, allowing the weight clip to slid over a barbell. The J-hook is sized in length, width and distance to accommodate hosting of dumbbells and kettlebells.

The other objective of the weight clip system is to provide a weight clip that is made of metal, such a steel or cast iron, with a J-hook and mounting collar lined with a durable elastomeric material in strategic locations that prevents the weight clip from sliding on a hosting barbell shaft and prevents hosted weights from jostling.

The other objective of the weight clip system is to provide strategically-placed apertures in both the J-hook and mounting collar portions, as well as set screws threadedly engaged therein to secure the weight clip on a barbell and to secure dumbbells and kettlebells to the weight clip, respectively.

Yet another objective of the weight clip system is to apply the weight clip to a barbell and tighten the set screw of the mounting collar. Then, add a hand weight, like a kettlebell, to the J-hook and secure the set screw.

Another objective of the weight clip system is to provide a weight clip that can be easily and fully gripped by a single hand, unlike most disc-shaped weight plates.

Yet another objective of the weight clip system is to provide a weight clip that allows multiple types of weight-lifting exercises to be done with the same types of weights. The weight clip allows dumbbells and kettlebells to replace or substitute for disc-shaped weight plates of specific weights.

Other objectives and aspects of the weight clip system will become apparent from the following detailed description, taken in conjunction with the accompanying drawings, which illustrate, by way for example, the features in accordance with embodiments of the invention.

The summary of the invention is provided as a general introduction to some of the embodiments of the invention, and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
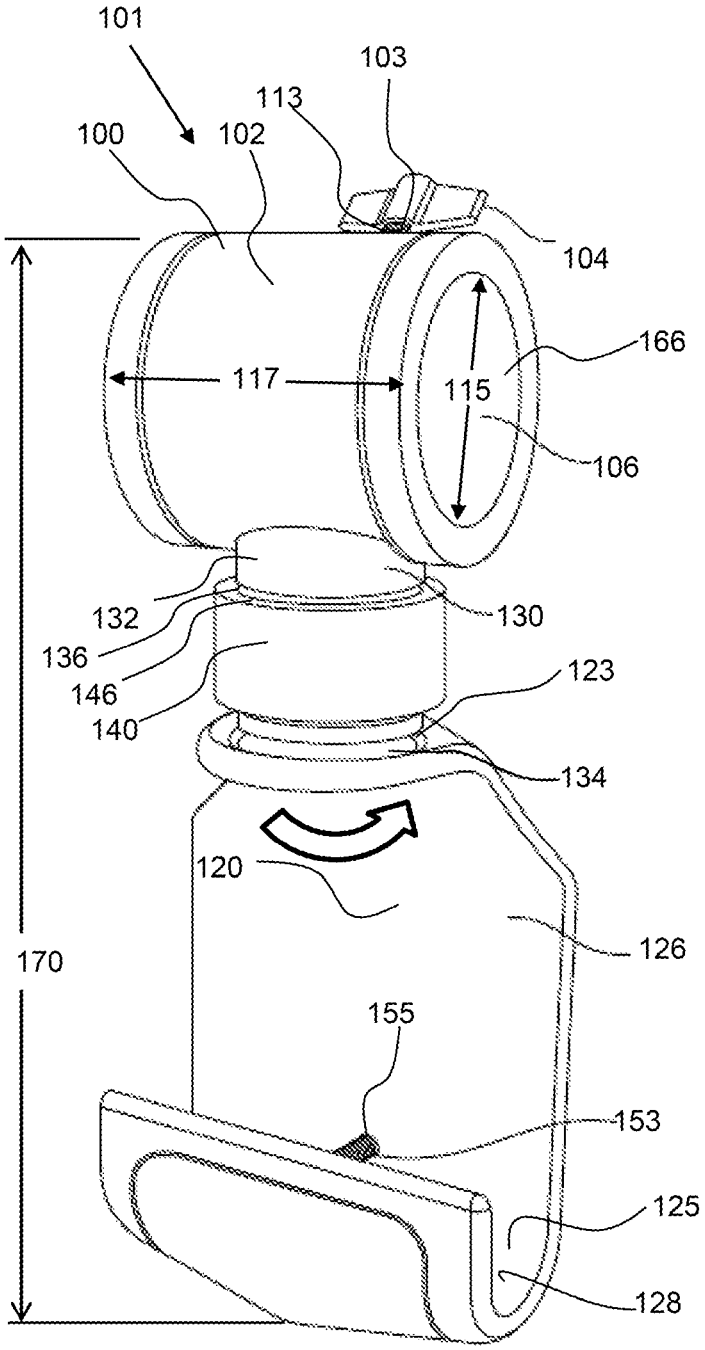
FIG. 1 shows a perspective view of an exemplary weight clip having a mounting collar coupled to a hook by a shaft.

Corresponding reference characters indicate corresponding parts throughout the several views of the figures. The figures represent an illustration of some of the embodiments of the present invention and are not to be construed as limiting the scope of the invention in any manner. Some of the figures may not show all of the features and components of the invention for case of illustration, but it is to be understood that where possible, features and components from one figure may be an included in the other figures. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations, and improvements of the described embodiments, will occur to those skilled in the art and all such alternate embodiments, combinations, modifications, improvements are within the scope of the present invention.

Referring to the FIGS., and particularly FIGS. 1 to 5, a weight clip system 101 includes a weight clip 100 having a mounting collar 102, a shaft 130, a swivel-lock 140, a hook 120, such as a J-hook 122 and collar set screw 103 and hook set screw 153. The hook 120 is configured to spin or rotate with respect to the mounting collar 102. The hook may be locked into a desired rotational position by the swivel-lock 140, which may be a threaded collar having lock threads 146 that engage with the shaft threads 136 to tighten down the hook to prevent the hook from rotating. The shaft 130 extends from a collar end 132 coupled with the mounting collar 102 to a hook end 134 coupled with the hook 120. A hook-shaft coupling 123 of the hook 120 may be coupled with the shaft 130 and extend over or into the hook end 134.

The mounting collar 102 has a collar threaded aperture 105 for receiving the collar set screw 103 therein. The collar set screw has male threads that engage with the collar threaded aperture to advance the collar set screw into collar-barbell aperture 108 to secure the mounting collar to a barbell. The collar set screw may have thumb flanges 104 to aid in manual tightening of the collar set screw.

The hook 120 has a hook threaded aperture 155 for receiving the hook set screw 153 therein. The hook set screw has male threads that engage with the hook threaded aperture to advance the hook set screw into cradle 128 of the hook to secure the free weight to the hook 120 and weight clip 100. The hook set screw may have thumb flanges 154 to aid in manual tightening of the hook set screw.

As shown in FIG. 1, the weight clip 100 has a length 170 from the mounting collar 102 to the bottom of the cradle 128 of the hook 120 that is configured for easy hand manipulation. The mounting collar 102 has a length 117 from a first end to a second end and a collar-barbell aperture diameter 115 for receiving a barbell therein.

Figure 2:
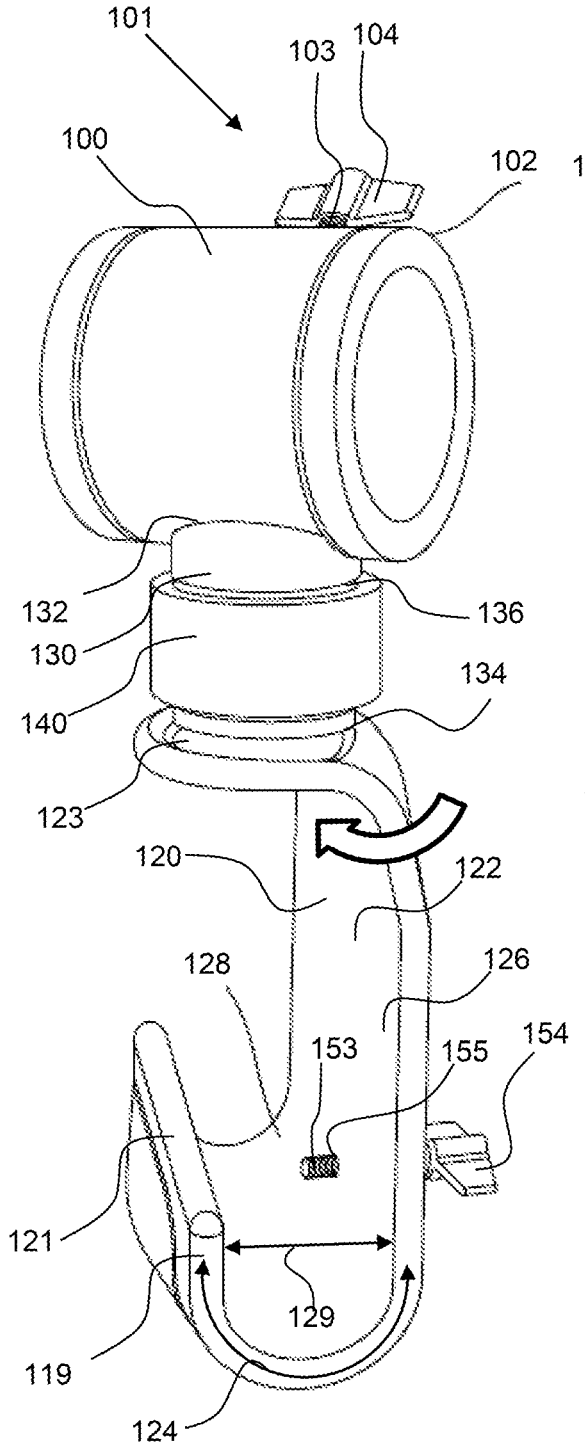
FIG. 2 shows a side view of the exemplary weight clip shown in FIG. 1.
Figure 3:
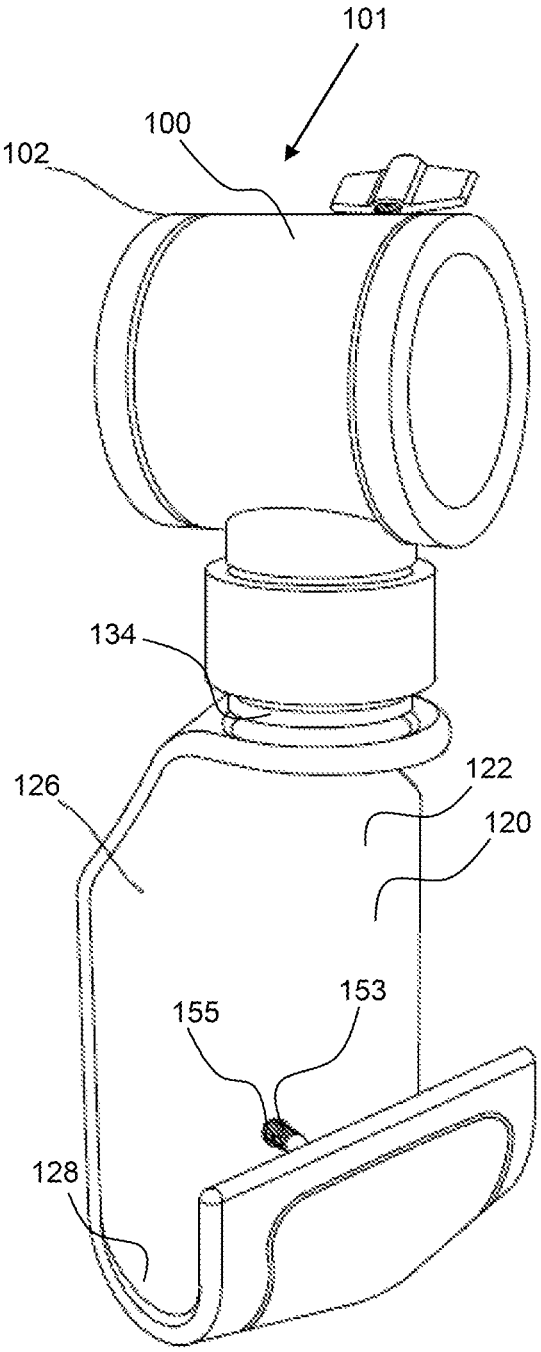
FIG. 3 shows a side view of the exemplary weight clip shown in FIG. 2 with the hook rotated about the shaft.

With reference now to FIGS. 2 and 3, the hook 120 is a J-hook 122 having a hook extension 126 that extends down from the shaft 130 to the cradle 128 of the hook 120. The hook extension 126 may be a planar extension as shown and the cradle is a curved portion of the hook 120 for receiving a cylindrical handle of a free weight. The cradle may extend along a radius from the hook extension 126 to the extended end portion 119 of the hook 120 a hook angle 124 of about 140 degrees or more, and preferably 160 degrees or more, or as much as 180 degrees and any range between and including the radius values provided. As shown, the hook angle is about 180 degrees and the extended end portion 119 and hook extension 126 extend in parallel with each other. The radius of the cradle 128 may define a diameter 129 of the cradle for receiving a cylindrical shaft of a free weight. The hook set screw 153 and thumb flanges are shown in FIG. 2 with the extended end of the hook set screw 153 extending into the cradle of the hook 120.

As shown in FIG. 3, the hook 120 has been rotated with respect to the mounting collar 102 as indicated by the bold arrow in FIG. 2.

Figure 4:
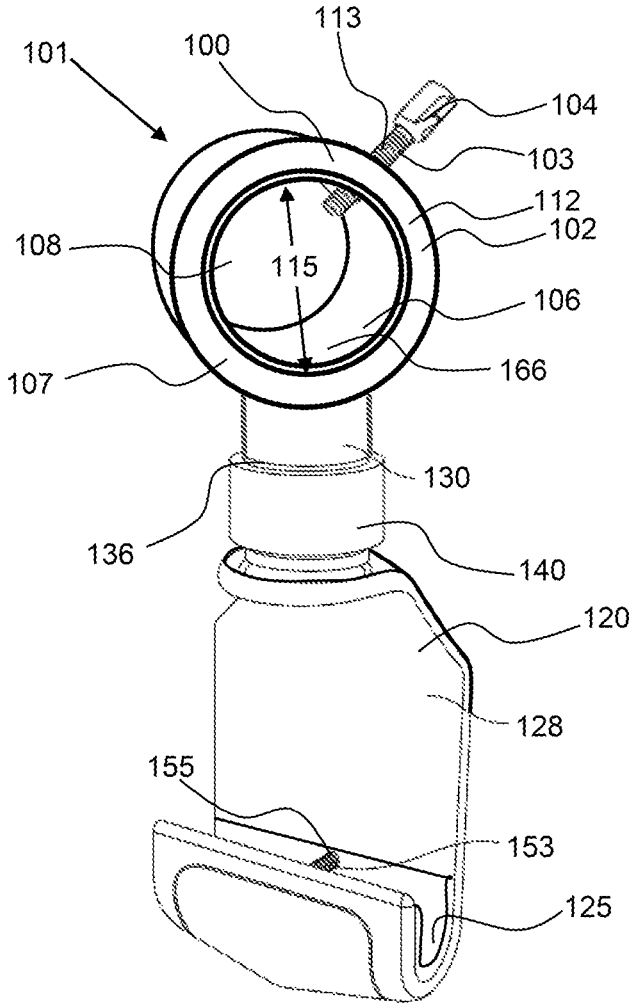
FIG. 4 shows a side view of the exemplary weight clip shown in FIG. 1 with the collar set screw extending through the mounting collar.

Referring now to FIG. 4, the collar set screw 103 and thumb flanges 104 are shown with the extended end of the collar set screw 103 extending into the collar-barbell aperture 108. The mounting collar wall 112 forms a ring 107 having an interior surface 106 around the collar-barbell aperture 108 for receiving a barbell therein. The collar-barbell aperture has a diameter 115 that is configured to extend around conventional barbells. An interior liner 166 is configured within the interior surface 106 of the collar-barbell aperture 108 and may be a polymer material to dampen vibration from the movement of the barbell with the free weights attached to the weight clip. Also, the hook 120 may have an interior hook liner 125 configured in the cradle 128 of the hook to dampen vibration of a weight retained in the cradle of the hook. Again, the hook liner 125 may be an elastomeric material and may extend up along the hook extension 126 and the extended end portion 119 of the hook 120. The extended end portion 119 may be parallel with the hook extension 126 from the extended end 121 down to the cradle 128.

Figure 5:
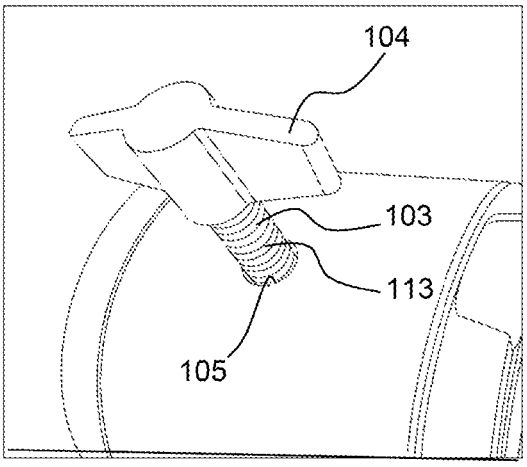
FIG. 5 shows the mounting collar portion of the weight clip and the collar set screw having thumb flanges and extending through the collar threaded aperture in the mounting collar.

FIG. 5 shows the collar set screw 103 having threads and thumb flanges 104 for enabling manual tightening of the collar set screw against a barbell.

Figure 6:
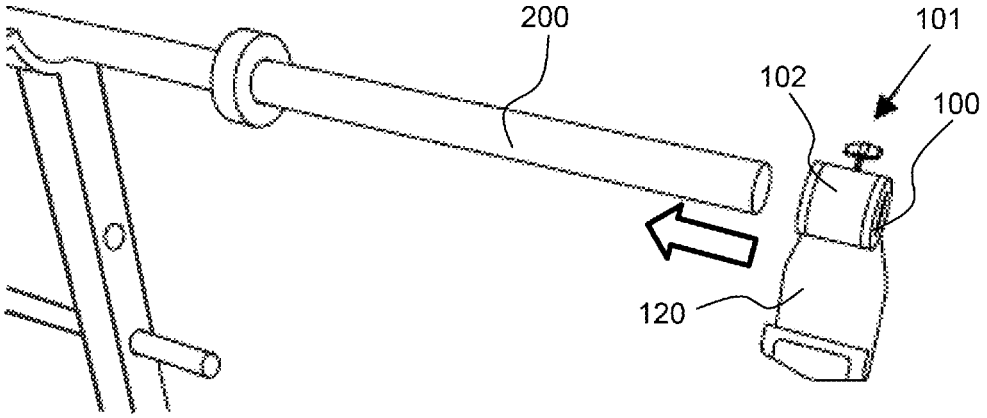
FIG. 6 shows the weight clip being slid onto a barbell.

As shown in FIG. 6, an exemplary weight clip 100 is being slid onto a barbell 200 as indicated by the bold arrow. The collar-barbell aperture 108 configured over the extended end of the barbell and then the weight clip is slid along the barbell.

Figure 7:
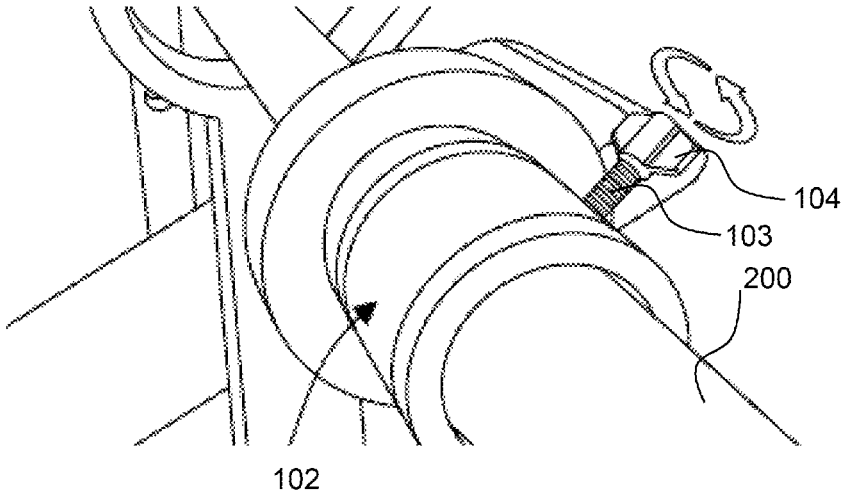
FIG. 7 shows the mounting collar portion of the weight clip being secured to the barbell by the collar set screw being tightened against the barbell.

As shown in FIG. 7, the collar set screw 103 has threads and thumb flanges 104 for enabling manual tightening of the collar set screw against a barbell as indicated by the rotational arrows. Rotating the collar set screw 103 a first direction will advance the collar set screw into the collar-barbell aperture to force the extended end of the collar set screw against the barbell, to secure the mounting collar to the barbell.

Figure 8:
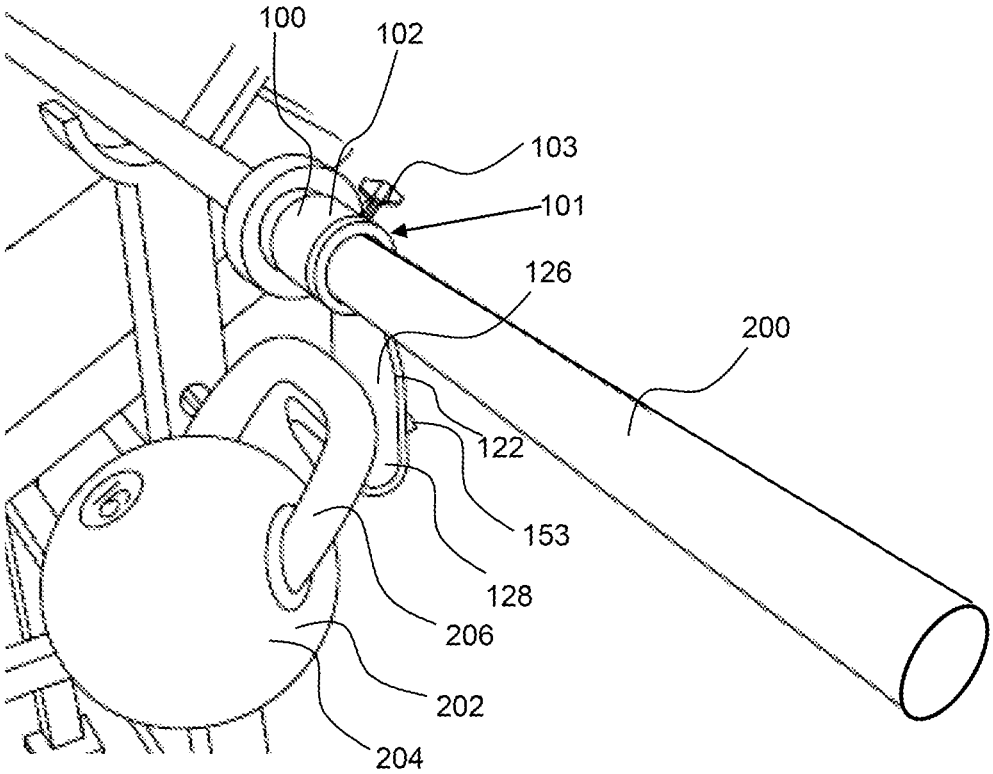
FIG. 8 shows a kettlebell being mounted upon the J-hook portion of the weight clip.

As shown in FIG. 8, a free weight 202, a kettle bell 204 is being place on the J-hook 122. The kettle bell handle 206 is being inserted into the cradle 128 of the J-hook 122. The hook set screw 153 may be tightened to secure the kettle bell 204 in the cradle of the J-hook.

Figure 9:
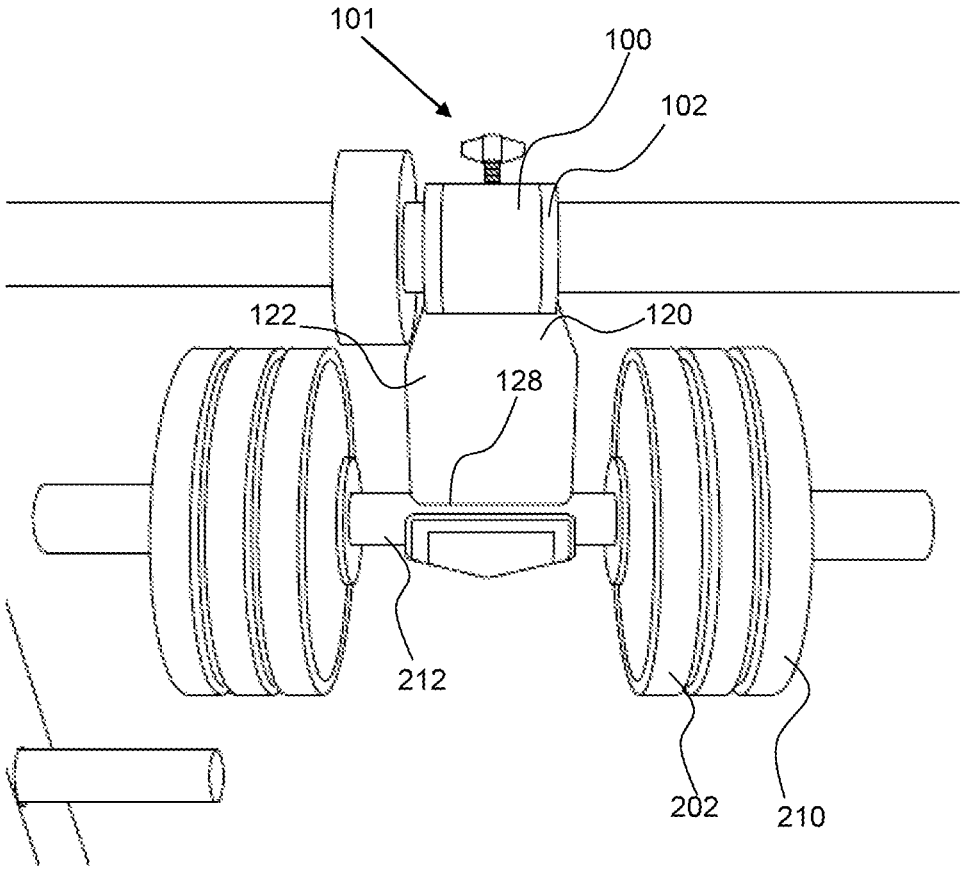
FIG. 9 shows a dumbbell mounted upon the J-hook portion of the weight clip.

As shown in FIG. 9, a free weight 202, a dumbbell 210 is being place on the J-hook 122. The dumbbell handle 212 is being inserted into the cradle 128 of the J-hook 122. The hook set screw (not shown) may be tightened to secure the dumbbell 210 in the cradle of the J-hook.

Figure 10:
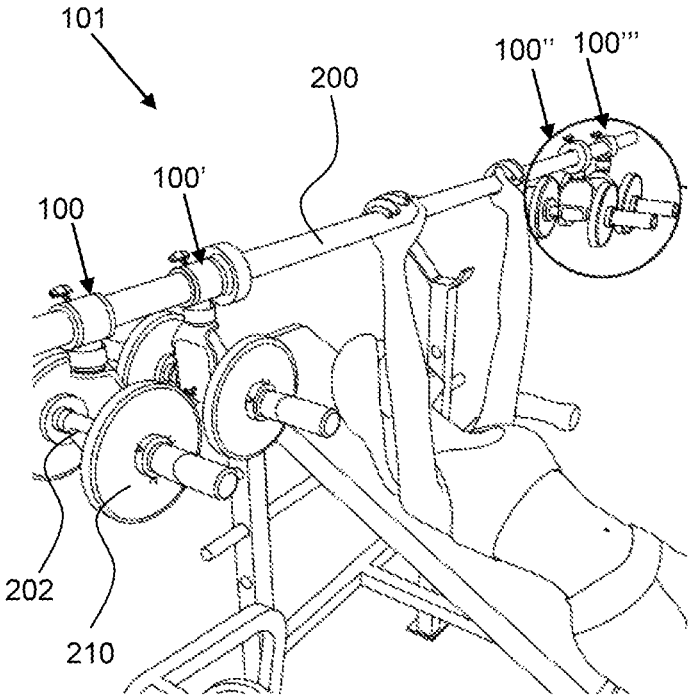
FIG. 10 shows a barbell having a plurality of weight clips retained thereon, each with a free weight hanging from the hook.
Figure 11:
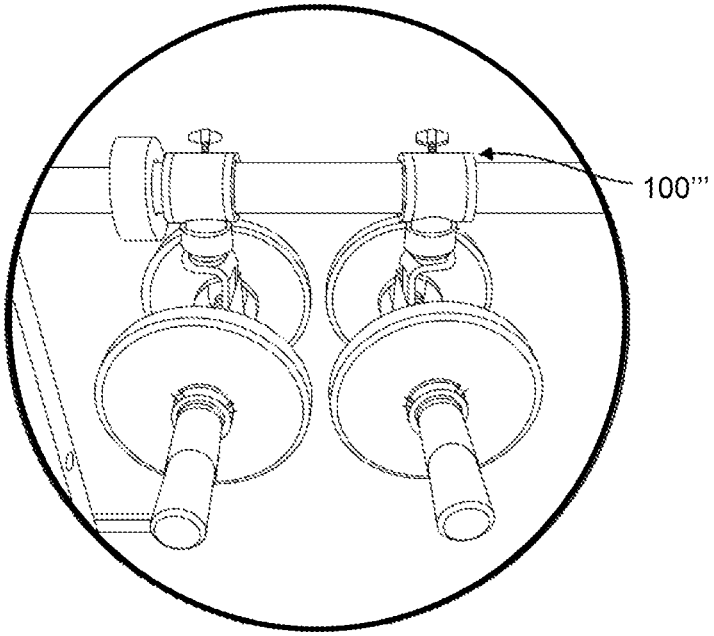
FIG. 11 shows an enlarged view of the barbell shown in FIG. 10 having a plurality of weight clips retained thereon, each with a free weight hanging from the hook.
Figure 12:
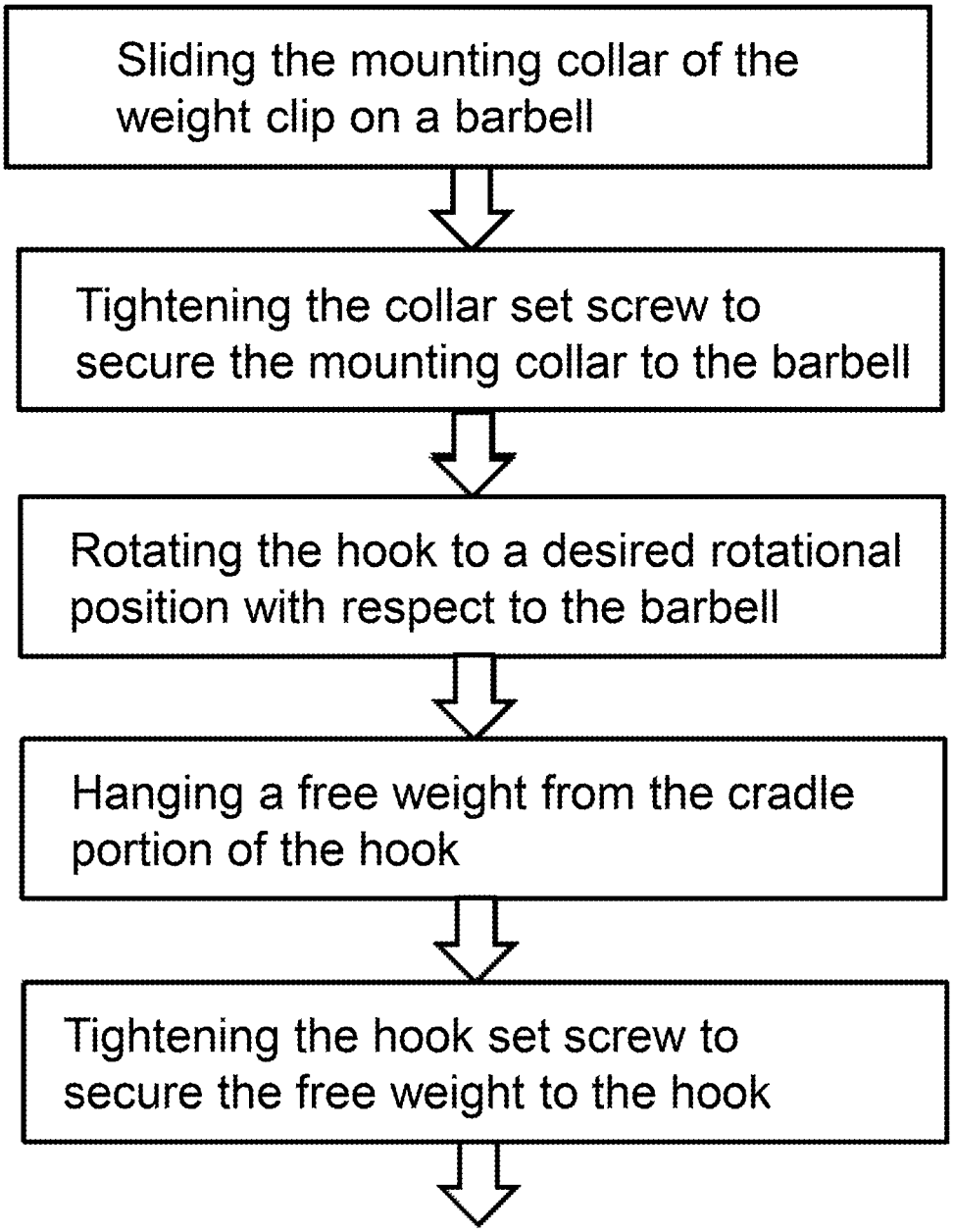
FIG. 12 shows a flow diagram of the method of detachably attaching a free weight to a barbell.

As shown in FIGS. 10 and 11, a plurality of weight clips 100, 100', 100", 100'" may be configured on a barbell 200. As shown, four dumbbells are detachably attached to the barbell with two being attached on one end of the barbell and two being attached on the opposing end of the barbell.

It will be apparent to those skilled in the art that various modifications, combinations and variations can be made in the present invention without departing from the scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A weight clip system for detachable attachment of a free weight to a barbell comprising:

said barbell and said free weight;

a weight clip comprising:

a mounting collar configured for sliding on said barbell having an interior surface configured to extend around said barbell;

a collar set screw that extends through the mounting collar and configured to secure the mounting collar to said barbell;

a shaft extending from the mounting collar and having a collar end coupled to the mounting collar and a hook end opposite to the collar end;

a hook, wherein the hook is connected to the hook end of the shaft and configured for hanging a free weight thereon;

a hook set screw that extends through the hook and configured to secure said free weight to the hook;

a hook-shaft coupling configured to allow rotation of the hook relative to the shaft;

a swivel-lock configured on the hook to extend over the shaft and configured to prevent rotation of the hook with respect to the mounting collar.

2. The weight clip system in accordance with claim 1, wherein the interior surface of the mounting collar forms a ring.

3. The weight clip system in accordance with claim 1, wherein the interior surface of the mounting collar comprises an interior liner.

4. The weight clip system in accordance with claim 3, wherein the interior liner is an elastomeric material configured to dampen vibration of the free weight detachably attached to the weight clip.

5. The weight clip system in accordance with claim 4, wherein the hook is a J-hook having a cradle that curves a radius from a hook extension to an extended end of the hook at least 140 degrees.

6. The weight clip system in accordance with claim 5, wherein the hook comprises a hook liner configured in the cradle of the hook.

7. The weight clip system in accordance with claim 6, wherein the hook liner is an elastomeric material configured to dampen vibration of the free weight detachably attached to the weight clip.

8. The weight clip system in accordance with claim 1, wherein the shaft has shaft threads and wherein the swivel-lock has threads that engage with the shaft threads; whereby tightening the swivel-lock by rotation of the swivel-lock prevents the hook from rotating with respect to the mounting collar.

9. The weight clip system in accordance with claim 1, wherein the free weight is a dumbbell.

10. The weight clip system in accordance with claim 1, wherein the free weight is a kettlebell.

11. The weight clip system in accordance with claim 1, wherein the hook is a J-hook having a cradle that curves a radius from a hook extension to an extended end of the hook at least 140 degrees.

12. The weight clip system in accordance with claim 11, wherein the J-hook has a hook extension that includes a planar portion between the shaft and the cradle.

13. The weight clip system in accordance with claim 1, wherein the collar set screw has thumb flanges to enable manual tightening of the collar set screw.

14. The weight clip system in accordance with claim 13, wherein the hook set screw has thumb flanges to enable manual tightening of the hook set screw against said free weight.

15. The weight clip system in accordance with claim 14, wherein the shaft has shaft threads and wherein the swivel-lock has threads that engage with the shaft threads; whereby tightening the swivel-lock by rotation of the swivel-lock prevents the hook from rotating with respect to the mounting collar.

16. The weight clip system in accordance with claim 1, wherein the hook set screw has thumb flanges to enable manual tightening of the hook set screw against said free weight.

17. The weight clip system in accordance with claim 1, wherein the weight clip is made from a material selected from the group consisting of: cast iron, tool steel, carbon alloy, high-density polyethylene.

18. A weight clip system for detachable attachment of a free weight to a barbell, comprising:

said barbell and said free weight;

a weight clip comprising:

a mounting collar configured for sliding on said barbell having an interior surface configured to extend around said barbell;

a collar set screw that extends through the mounting collar and configured to secure the mounting collar to said barbell;

a shaft extending from the mounting collar and having a collar end coupled to the mounting collar and a hook end opposite to the collar end;

a hook, wherein the hook is connected to the hook end of the shaft configured for hanging a free weight thereon;

a hook set screw that extends through the hook to secure said free weight to the hook;

wherein the collar set screw has thumb flanges to enable manual tightening of the collar set screw against said barbell;

a hook-shaft coupling configured to allow rotation of the hook relative to the shaft;

a swivel-lock configured on the hook to extend over the shaft and configured to prevent rotation of the hook with respect to the mounting collar;

a collar set screw extending through the mounting collar and configured to secure the weight clip to said barbell; and a hook set screw extending through the hook and configured to secure said free weight to the hook;

wherein the hook set screw has thumb flanges to enable manual tightening of the hook set screw;

wherein the interior surface of the mounting collar forms a ring;

wherein the interior surface of the mounting collar comprises an interior liner that is an elastomeric material configured to dampen vibration of the free weight detachably attached to the weight clip; and wherein the shaft has shaft threads and wherein the swivel-lock has threads that engage with the shaft threads; whereby tightening the swivel-lock by rotation of the swivel-lock prevents the hook from rotating with respect to the mounting collar.

19. A method of securing a free weight to a barbell comprising:

a) providing the weight clip according to claim 1;

b) providing a barbell and a free weight;

c) sliding the mounting collar over an extended end of said barbell;

d) securing the mounting collar to the barbell by tightening the collar set screw;

e) placing a free weight on the hook; and f) securing the free weight to the hook by tightening the hook set screw.

20. The method of claim 19, further comprising:

rotating the hook to a hook rotational position with respect to the mounting collar; and securing the hook in said hook rotational position with respect to mounting collar by tightening the swivel-lock.

* * * * *